US010920998B2

(12) United States Patent
Aoyama et al.

(10) Patent No.: US 10,920,998 B2
(45) Date of Patent: Feb. 16, 2021

(54) OUTDOOR UNIT FOR AIR-CONDITIONING APPARATUS

(71) Applicant: Mitsubishi Electric Corporation, Tokyo (JP)

(72) Inventors: Yutaka Aoyama, Tokyo (JP); Yudai Morikawa, Tokyo (JP); Takahiro Yano, Tokyo (JP); Motoya Nakahara, Tokyo (JP); Keizo Kamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1 day.

(21) Appl. No.: 16/467,863

(22) PCT Filed: Feb. 20, 2017

(86) PCT No.: PCT/JP2017/006169
§ 371 (c)(1),
(2) Date: Jun. 7, 2019

(87) PCT Pub. No.: WO2018/150581
PCT Pub. Date: Aug. 23, 2018

(65) Prior Publication Data

US 2019/0360704 A1 Nov. 28, 2019

(51) Int. Cl.
*F24F 1/16* (2011.01)

(52) U.S. Cl.
CPC ..... *F24F 1/16* (2013.01)

(58) Field of Classification Search
CPC ..... F24F 1/16; F24F 1/50; F24F 1/48; F24F 1/06; F28F 1/32
See application file for complete search history.

(56) References Cited

U.S. PATENT DOCUMENTS

| | | | | |
|---|---|---|---|---|
| 3,759,321 | A * | 9/1973 | Ares | F24F 1/14 165/125 |
| 2002/0134099 | A1* | 9/2002 | Mochizuki | F24F 1/46 62/285 |
| 2016/0131371 | A1* | 5/2016 | Aoyama | F24F 1/56 165/122 |
| 2016/0146476 | A1* | 5/2016 | Morikawa | F28D 1/0426 165/157 |

FOREIGN PATENT DOCUMENTS

| | | | |
|---|---|---|---|
| JP | H11-351789 | A | 12/1999 |
| JP | 2001-201111 | A | 7/2001 |
| JP | 2006-317099 | A | 11/2006 |
| JP | 2012-145279 | A | 8/2012 |
| JP | 2014-238214 | A | 12/2014 |

* cited by examiner

*Primary Examiner* — Emmanuel E Duke
(74) *Attorney, Agent, or Firm* — Posz Law Group, PLC

(57) ABSTRACT

An outdoor unit for an air-conditioning apparatus includes a body frame having, in a side face, an air inlet from which outside air is suctioned, the body frame including a hanger-receiving portion in an upper part, the hanger-receiving portion including a beam-like supporting part; an outdoor heat exchanger provided inside the body frame and extending along the air inlet; a hanging portion engaging with the outdoor heat exchanger; and a connecting element connecting the hanger-receiving portion and the hanging portion to each other. The outdoor heat exchanger is supported by the hanger-receiving portion through the hanging portion and the connecting element.

12 Claims, 11 Drawing Sheets

OUTDOOR UNIT FOR AIR-CONDITIONING APPARATUS

CROSS REFERENCE TO RELATED APPLICATION

This application is a U.S. national stage application of PCT/JP2017/006169 filed on Feb. 20, 2017, the contents of which are incorporated herein by reference.

TECHNICAL FIELD

The present invention relates to outdoor units which include heat exchangers and are intended for use in air-conditioning apparatuses, and particularly to a structure of supporting a heat exchanger.

BACKGROUND ART

Outdoor units intended for use in air-conditioning apparatuses installed in buildings, such as high-rises and commercial facilities, each include a heat exchanger provided in a housing. The heat exchanger includes a plurality of heat-exchanging units that are stacked in a vertical direction. Each of the heat-exchanging units includes a plurality of fins and a plurality of heat exchanger tubes arranged orthogonally to the plurality of fins.

The fins of the heat exchanger are thin. Therefore, if such fins contact other components because of vibrations or any other reason that may occur during transportation, the fins easily deform to block air passages, leading to a reduction in heat-exchanging performance. Moreover, in the area of the heat exchanger where air passages are closed by the deformed fins, drainage of dew water resulting from heat exchange is hindered. If such residual dew water is frozen, the volume of the dew water expands. Consequently, a load is applied to the heat exchanger and may damage the heat exchanger.

Accordingly, in a known outdoor unit, sheet-metal components are attached to ends of a heat exchanger, and the sheet-metal components are supported by a housing (see Patent Literature 1, for example). According to Patent Literature 1, an upper part and a lower part at one end of the heat exchanger are fixed to an element, such as an outer shell, by using an upper side plate and a lower side plate, respectively.

On the other hand, the space for installing outdoor units for air-conditioning apparatuses is limited. Therefore, outdoor units are occasionally arranged side by side horizontally. In such a case, each of the outdoor units suctions air from side faces and blows the air upward through a fan provided at the top. In such a configuration, the speed of airflow at the side faces of the outdoor unit becomes lower toward the lower side and higher toward the upper side. To efficiently utilize the part where the speed of airflow is high, there has been proposed in which a heat exchanger is provided at a position corresponding to an upper part of side faces forming a body of an outdoor unit (see Patent Literature 2, for example). The outdoor unit disclosed by Patent Literature 2 includes a receiving element serving as a seat for holding the heat exchanger. The receiving element is provided at a central part of the body of the outdoor unit in the height direction. Thus, the heat exchanger is positioned in the upper part of the outdoor unit.

CITATION LIST

Patent Literature

Patent Literature 1: Japanese Unexamined Patent Application Publication No. 2006-317099

Patent Literature 2: Japanese Unexamined Patent Application Publication No. 2001-201111

SUMMARY OF INVENTION

Technical Problem

In the outdoor unit disclosed by Patent Literature 1, only the ends of the heat exchanger are supported. Therefore, a central part of the heat exchanger in the width direction may bend because of vibrations or any other reason during transportation and contact other components to cause deformation. Such a situation tends to occur particularly in an outdoor unit including a large heat exchanger.

In the outdoor unit disclosed by Patent Literature 2 in which the heat exchanger is supported from below, part of the fins at the bottom of the heat exchanger are in contact with the receiving element. Therefore, the part of the fins at the bottom of the heat exchanger may deform from buckling. Moreover, if the receiving element is made of metal, the coating of the fins may peel because the part of the fins at the bottom of the heat exchanger and the receiving element are in contact with each other. Such peeling may lead to corrosion of the fins. In addition, in the outdoor unit disclosed by Patent Literature 2, since the part of the fins at the bottom of the heat exchanger and the receiving element are in contact with each other, the drainage of waste water such as dew water resulting from heat exchange may be hindered. If such residual dew water is frozen, the volume of the dew water expands. Consequently, a load is applied to the heat exchanger and may damage the heat exchanger.

The present invention has been made in order to solve the above problems and an object thereof is to provide an outdoor unit intended for an air-conditioning apparatus and that hardly causes the above problems triggered by deformation of a heat exchanger due to vibrations or any other reason that may occur during transportation and by a configuration of supporting the heat exchanger from below.

Solution to Problem

An outdoor unit for an air-conditioning apparatus according to an embodiment of the present invention includes a body frame having, in a side face, an air inlet from which outside air is suctioned, the body frame including a hanger-receiving portion in an upper part, the hanger-receiving portion including a beam-like supporting part; an outdoor heat exchanger including a first heat exchanger provided inside the body frame and extending along the air inlet, and a second heat exchanger extending along an inner surface of the first heat exchanger; a hanging portion including a first hanger element engaging with the first heat exchanger, and a second hanger element engaging with the second heat exchanger; and a connecting element connecting the hanger-receiving portion and the hanging portion to each other. The outdoor heat exchanger is supported by the hanger-receiving portion through the hanging portion and the connecting element.

Advantageous Effects of Invention

According to the embodiment of the present invention, the hanger-receiving portion provided in the upper part of the body frame and the hanging portion engaging with the outdoor heat exchanger are connected to each other by the connecting element. Thus, the outdoor heat exchanger can be supported in a hanging manner. Therefore, deformation of the heat exchanger due to vibrations or any other reason that may occur during transportation can be suppressed, and the occurrence of various problems triggered by supporting the heat exchanger from below can be suppressed.

DESCRIPTION OF EMBODIMENTS

Embodiment 1

Figure 1:
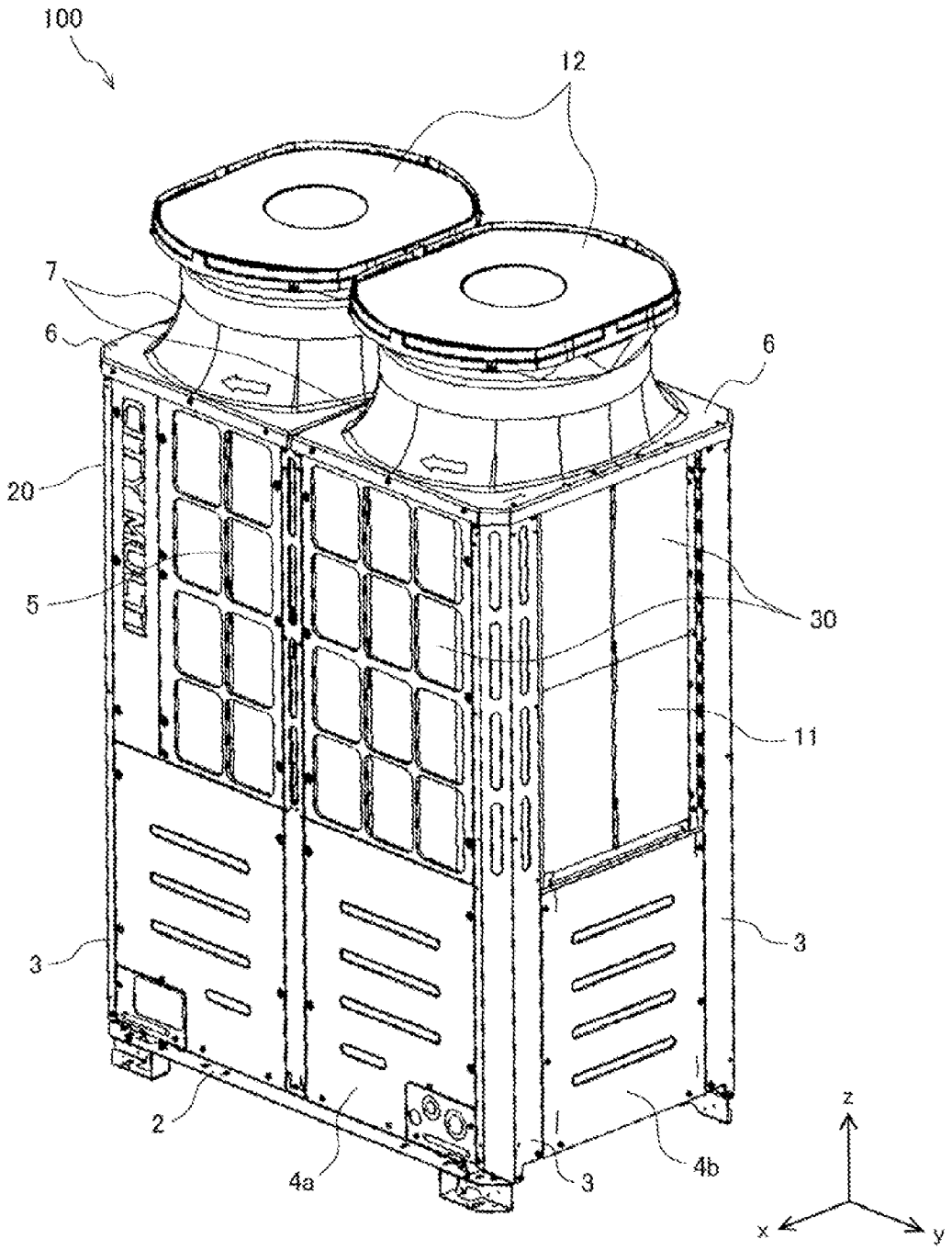
FIG. 1 is a perspective view illustrating an external appearance of an outdoor unit for an air-conditioning apparatus according to Embodiment 1 of the present invention.

FIG. 1 is a perspective view illustrating an appearance of an outdoor unit for an air-conditioning apparatus according to Embodiment 1 of the present invention. In FIG. 1, relative to an outdoor unit 100, the front-rear direction is defined as the x-axis direction, the horizontal direction is defined as the y-axis direction, and the height direction is defined as the z-axis direction. This also applies to the other drawings to be referred to below. Furthermore, regarding the outdoor unit 100 illustrated in FIG. 1, a face on the positive side of the x axis is defined as the front face, a face on the positive side of the x axis is defined as the rear face, a face on the positive side of the y axis is defined as the right side face, a face on the negative side of the y axis is defined as the left side face, a face on the positive side of the z axis is defined as the top face, and a face on the negative side of the z axis is defined as the bottom face.

As illustrated in FIG. 1, a body frame 20 of the outdoor unit 100 includes a bottom plate 2, four pillars 3, four panels including a front panel 4*a* and a right side panel 4*b*, a fin guard 5, two top panels 6, and two fan guards 7. The four panels of the body frame 20 further include a rear panel (not illustrated) and a left side panel (not illustrated), in addition to the front panel 4*a* and the right side panel 4*b*. The rear panel is provided on the rear side of the outdoor unit 100 so as to face the front panel 4*a*. The left side panel is provided on the left side of the outdoor unit 100 so as to face the right side panel 4*b*. The four panels are each positioned between adjacent ones of the pillars 3 and are each fixed to the body frame 20 with screws or other similar elements.

The bottom plate 2 has a rectangular shape in plan view and is positioned on the bottom side of the body frame 20. Herein, plan view refers to a view seen in the z-axis direction represented in FIG. 1 and is equivalent to sectional view taken in an X-Y plane. The four pillars 3 stand at the four respective corners of the bottom plate 2. The lower ends of the pillars 3 are fixed to the four respective corners of the bottom plate 2 with connecting elements such as bolts.

The fin guard 5 illustrated in FIG. 1 is provided above the front panel 4*a* and standing along the front face of the outdoor unit 100. The fin guard 5 has a plurality of openings that allow air to freely flow therethrough. The fin guard 5 protects fins 34*f* (not illustrated in FIG. 1) included in an outdoor heat exchanger 30. The body frame 20 includes another fin guard 5, which is not illustrated in FIG. 1, provided above the rear panel and standing along the rear face of the outdoor unit 100. Needless to say, the body frame 20 may include yet another fin guard 5 provided above the right side panel 4*b* and standing along the right side face of the outdoor unit 100. Likewise, the body frame 20 may include yet another fin guard 5 provided above the left side panel and standing along the left side face of the outdoor unit 100.

The two top panels 6 each have a rectangular contour in plan view and have an opening at a central part thereof. The two top panels 6 extend in an x-y plane and is opposite to the bottom plate 2. The contour of the combination of the two top panels 6 has the same shape and the same size as the bottom plate 2. The top panels 6 are fixed to the upper ends of the pillars 3 and the fin guards 5. The four corners of the combination of the two top panels 6 are fixed to the upper ends of the pillars 3 with connecting elements such as bolts.

The two fan guards 7 are provided for the respective top panels 6. The fan guards 7 each cover the opening provided at the central part of a corresponding one of the top panels 6 and protect a corresponding one of fans 50 (not illustrated in FIG. 1). The fan guards 7 each have a cylindrical shape in such a manner as to cover the fan 50.

The front face of the body frame 20 that is covered by the fin guard 5, and the two side faces and the rear face of the body frame 20 that are not covered by the fin guard 5 serve as air inlets 11 from which the outdoor unit 100 suctions air. A portion of each of the fan guards 7 where air is allowed to flow therethrough serves as an air outlet 12 from which the outdoor unit 100 blows air. A space in the body frame 20 and below the air outlets 12 is provided with two fans 50. Needless to say, the outdoor unit 100 may include a single fan 50.

The outdoor heat exchanger 30 is a combination of two heat exchangers each having an L shape in plan view. In FIG. 1, one of the heat exchangers included in the outdoor heat exchanger 30 that extends along the front face and the right side face of the outdoor unit 100 is illustrated. The outdoor heat exchanger 30 includes another heat exchanger that extends along the rear face and the left side face of the outdoor unit 100.

Figure 2:
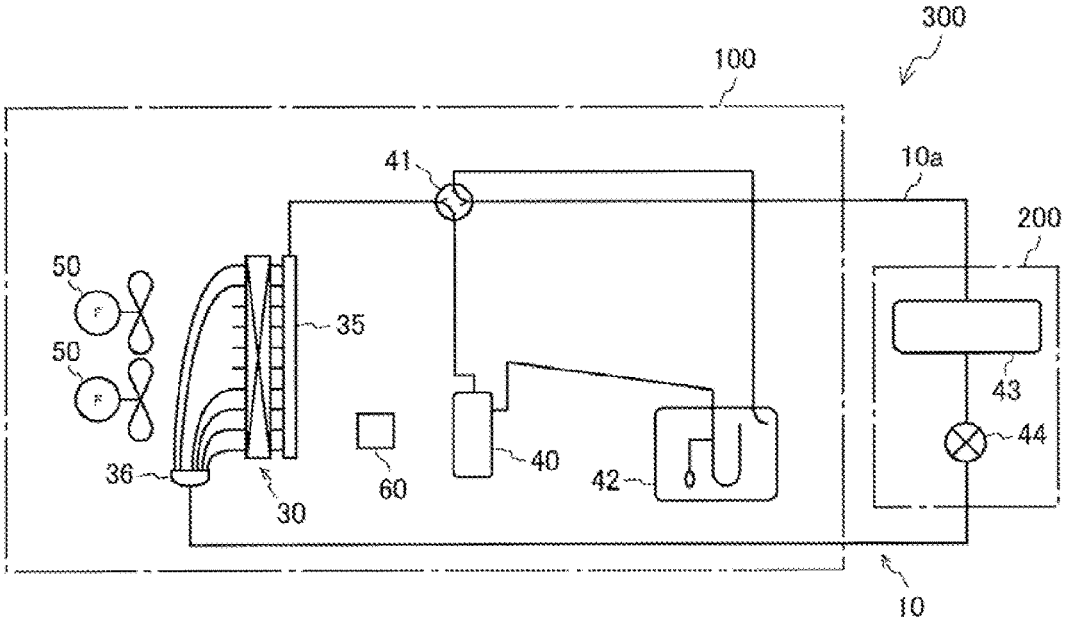
FIG. 2 is a circuit diagram illustrating a refrigeration circuit of an air-conditioning apparatus according to Embodiment 1 of the present invention.

FIG. 2 is a circuit diagram illustrating a refrigeration circuit of an air-conditioning apparatus according to Embodiment 1 of the present invention. As illustrated in FIG. 2, an air-conditioning apparatus 300 includes the outdoor unit 100 and an indoor unit 200. The outdoor unit 100 includes a compressor 40, a four-way valve 41, the outdoor heat exchanger 30, an accumulator 42, and the two fans 50. The indoor unit 200 includes an indoor heat exchanger 43, an expansion valve 44, and an indoor-unit fan (not illustrated). The indoor-unit fan generates a flow of air suctioned from the outside and flowing through the indoor heat exchanger 43.

The fans 50 generate a flow of air suctioned from the outside and flowing through the outdoor heat exchanger 30. More specifically, the fans 50 are provided above the outdoor heat exchanger 30 and generate a flow of air when rotated. That is, when the fans 50 are rotated, outside air is suctioned horizontally into the air inlets 11 provided on the four sides, which are the front and rear faces and the two side faces, of the outdoor unit 100 of the air-conditioning apparatus 300, flows through the outdoor heat exchanger 30, and is suctioned into the body frame 20. In the body frame 20, the air is redirected to flow in the height direction. That is, the air suctioned into the body frame 20 further flows in the height direction, passes through the fans 50, and is blown upward from the air outlets 12 provided at the top of the body frame 20.

The speed of the air flowing through the outdoor heat exchanger 30 varies with the positional relationship between the fans 50 and the outdoor heat exchanger 30. Specifically, the flow of incoming air suctioned from the air inlets 11 and passing through the outdoor heat exchanger 30 is higher on the upper side of the outdoor heat exchanger 30 that is close to the fans 50 and lower on the lower side of the outdoor heat exchanger 30. Therefore, in a case where the fans 50 are provided at the top of the outdoor unit 100, if the outdoor heat exchanger 30 is provided on the lower side of the outdoor unit 100 or extends over the entirety of the outdoor unit 100 in the vertical direction, efficient heat exchange cannot be realized in many areas, leading to a reduction in the efficiency of heat exchange by the outdoor heat exchanger 30. In this respect, the outdoor unit 100 according to Embodiment 1 includes the outdoor heat exchanger 30 provided on the upper side and extending along the front face, the rear face, the right side face, and the left side face. Therefore, efficient heat exchange is realized.

The compressor 40 is driven by, for example, an inverter and compresses refrigerant. The four-way valve 41 switches the flow path of the refrigerant circulating through a refrigerant circuit 10. The outdoor heat exchanger 30 is, for example, a fin-and-tube heat exchanger and allows air and the refrigerant to exchange heat therebetween. The outdoor heat exchanger 30 includes a header unit 35 and a distributor 36.

The accumulator 42 is provided on a suction side of the compressor 40. The accumulator 42 separates the refrigerant into liquid refrigerant and gas refrigerant so that the compressor 40 suctions the gas refrigerant. The indoor heat exchanger 43 is, for example, a fin-and-tube heat exchanger and allows air and the refrigerant to exchange heat therebetween. The expansion valve 44 is, for example, an electronic expansion valve and expands the refrigerant by decompressing the refrigerant.

To summarize, the air-conditioning apparatus 300 includes the refrigerant circuit 10 in which the compressor 40, the four-way valve 41, the outdoor heat exchanger 30, the expansion valve 44, the indoor heat exchanger 43, and the accumulator 42 are connected to one another by a refrigerant tube 10*a* and through which the refrigerant circulates. That is, the compressor 40 and associated elements such as tubes included in the outdoor unit 100 are connected to the indoor heat exchanger 43 and the expansion valve 44 of the indoor unit 200, whereby the refrigerant circuit 10 through which the refrigerant flows is formed. In Embodiment 1, the compressor 40 and the associated elements such as tubes that are included in the refrigerant circuit 10 are provided on the bottom plate 2 illustrated in FIG. 1.

The outdoor unit 100 further includes a controller 60 that controls operations of relevant elements such as the compressor 40 and the four-way valve 41. The controller 60 is provided on the inner side of the four panels. The controller 60 may have a function of controlling the operation of the expansion valve 44. Alternatively, the indoor unit 200 may include an indoor controller that controls the operation of the expansion valve 44, so that the controller 60 can control the refrigerant circuit 10 in cooperation with the indoor controller.

When the air-conditioning apparatus 300 is in a cooling operation, the four-way valve 41 forms flow paths illustrated by solid lines in FIG. 2. Specifically, in the cooling operation, the refrigerant circuit 10 operates as follows. Gas refrigerant compressed by the compressor 40 to have a high temperature and a high pressure flows through the four-way valve 41 and is sent to the outdoor heat exchanger 30. The gas refrigerant thus sent to the outdoor heat exchanger 30 is cooled by the air suctioned from the outside with the rotation of the fans 50, thereby being condensed into high-pressure liquid refrigerant. The liquid refrigerant discharged from the outdoor heat exchanger 30 is sent to the indoor unit 200, adiabatically expanded by the expansion valve 44, and takes away heat from the air suctioned into the indoor heat exchanger 43 with the rotation of the indoor-unit fan, thereby evaporating into low-pressure gas refrigerant. The low-pressure gas refrigerant flows through the four-way valve 41 and is separated into gas and liquid in the accumulator 42. Then, only the refrigerant gas is suctioned into the compressor 40. Thus, in the refrigerant circuit 10, the refrigerant repeatedly undergoes the above refrigeration cycle including compression, condensation, expansion, and evaporation.

When the air-conditioning apparatus 300 is in a heating operation, the four-way valve 41 forms flow paths illustrated by broken lines in FIG. 2. That is, in the heating operation, the four-way valve 41 switches the flow path of the refrigerant such that the refrigerant flows in a direction opposite to the direction for the cooling operation. Specifically, in the heating operation, the refrigerant circuit 10 operates as follows. Gas refrigerant compressed by the compressor 40 to have a high temperature and a high pressure flows through the four-way valve 15 and is sent to the indoor heat exchanger 43. The gas refrigerant thus sent to the indoor heat exchanger 43 is cooled by the air suctioned from the outside with the rotation of the indoor-unit fan, thereby being condensed into high-pressure liquid refrigerant. The liquid refrigerant discharged from the indoor heat exchanger 43 is adiabatically expanded by the expansion valve 44 into two-phase refrigerant having a low temperature and a low pressure and is sent to the outdoor heat exchanger 30. In the outdoor heat exchanger 30, the refrigerant takes away heat from the air suctioned with the rotation of the fans 50, thereby evaporating into low-pressure gas refrigerant. The low-pressure gas refrigerant flows through the four-way valve 41 and is separated into gas and liquid in the accumulator 42. Then, only the refrigerant gas is suctioned into the compressor 40. Thus, in the refrigerant circuit 10, the refrigerant repeatedly undergoes the above refrigeration cycle including compression, condensation, expansion, and evaporation.

As described above, the outdoor heat exchanger 30 condenses gas refrigerant into liquid refrigerant in the cooling operation, and evaporates two-phase refrigerant into gas refrigerant in the heating operation.

Figure 3:
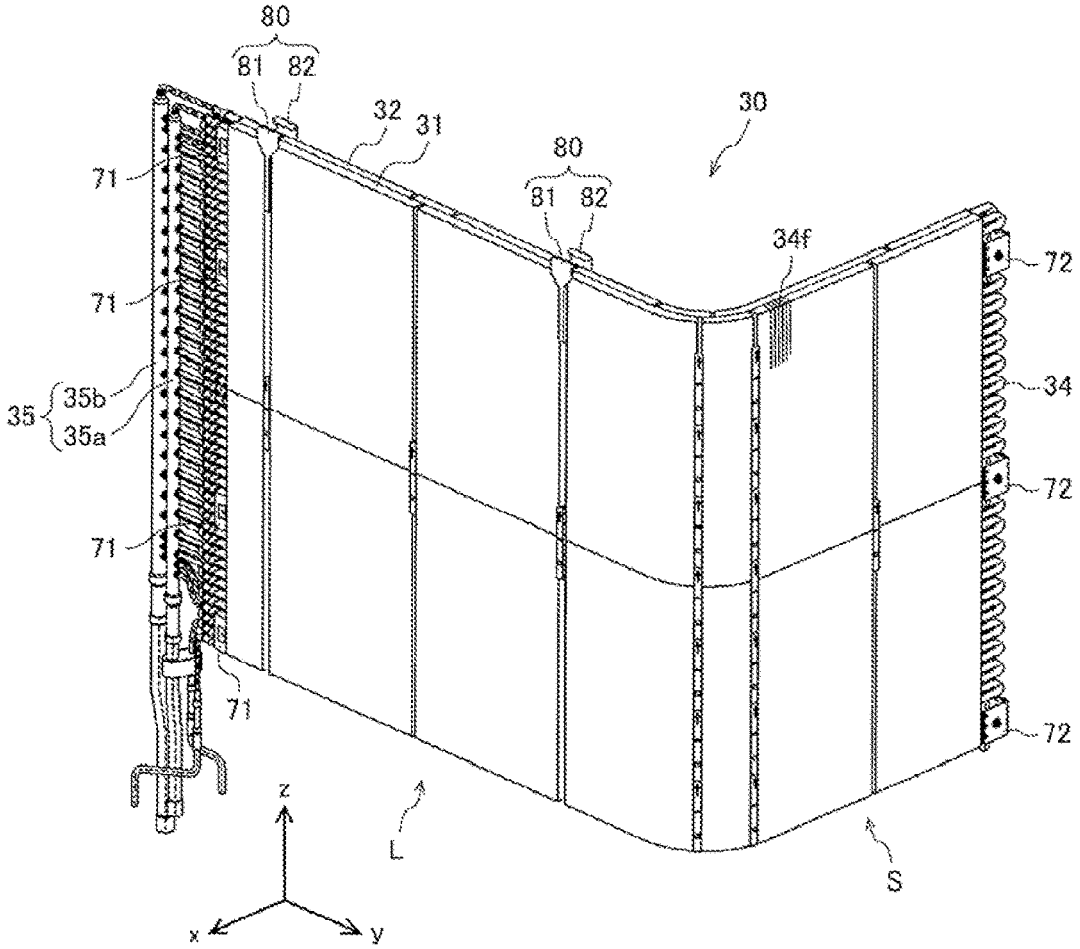
FIG. 3 is a perspective view illustrating a schematic configuration of the outdoor heat exchanger illustrated in FIG. 1.

FIG. 3 is a perspective view illustrating a schematic configuration of the outdoor heat exchanger illustrated in FIG. 1. As described above, the outdoor heat exchanger 30 is a combination of two heat exchangers each having an L shape in plan view, and the combination generally forms a rectangular shape in plan view. In FIG. 3, one of the heat exchangers is illustrated, and this heat exchanger will be hereinafter described as the outdoor heat exchanger 30.

The outdoor heat exchanger 30 has an L shape in plan view with a long-side portion L extending along the y axis and a short-side portion S extending along the x axis. The outdoor heat exchanger 30 includes a first heat exchanger 31 positioned on the windward side of the flow of incoming air generated by the fans 50, and a second heat exchanger 32 positioned on the leeward side of the flow of the incoming air relative to the first heat exchanger 31.

The first heat exchanger 31 extends along the air inlets 11 and is positioned in the body frame 20. The second heat exchanger 32 extends along an inner surface of the first heat exchanger 31. In an area where the first heat exchanger 31 and the second heat exchanger 32 overlap each other, the air suctioned from the air inlets 11 first flows through the first heat exchanger 31 and then through the second heat exchanger 32, and is suctioned into the body frame 20.

The first heat exchanger 31 and the second heat exchanger 32 each include heat exchanger tubes 34 provided with a plurality of plate-like fins 34*f*, a header unit 35 including a tube to which the heat exchanger tubes 34 are connected, and the distributor 36, all of which are connected to one another. In FIG. 3, the fins 34*f* are illustrated only partially for simplicity.

The header unit 35 includes a first header 35*a* to which the heat exchanger tubes 34 of the first heat exchanger 31 are connected, and a second header 35*b* to which the heat exchanger tubes 34 of the second heat exchanger 32 are connected. In the cooling operation in which the outdoor heat exchanger 30 serves as a condenser, the distributor 36 merges the flows of the refrigerant suctioned thereinto from the heat exchanger tubes 34 and discharges the merged refrigerant toward the indoor unit 200. In the heating operation in which the outdoor heat exchanger 30 serves as an evaporator, the distributor 36 receives the refrigerant from the indoor unit 200 and distributes the refrigerant to the heat exchanger tubes 34. The distributor 36 includes distributors, which are not illustrated, provided in correspondence with the first heat exchanger 31 and the second heat exchanger 32, respectively.

To summarize, in the cooling operation, the high-temperature, high-pressure gas refrigerant resulting from the compression by the compressor 40 is distributed to the first header 35*a* and the second header 35*b*, undergoes heat exchange in the heat exchanger tubes 34 of the first heat exchanger 31 and the second heat exchanger 32, is discharged from the distributors 36 of the first heat exchanger 31 and the second heat exchanger 32, and is merged. In the heating operation, the low-temperature, low-pressure two-phase refrigerant flowing from the indoor unit 200 is distributed to the respective distributors 36 of the first heat exchanger 31 and the second heat exchanger 32, evaporates in the heat exchanger tubes 34 of the first heat exchanger 31 and the second heat exchanger 32, is discharged from the first header 35*a* and the second header 35*b*, is merged, and is discharged as gas refrigerant. The flow rate of the refrigerant in the first heat exchanger 31 and the second heat exchanger 32 is adjustable by changing the diameter or the length of the tube connecting each set of the heat exchanger tubes 34 and a corresponding one of the distributors 36.

The outdoor unit 100 includes a plurality of one-end retaining elements 71, a plurality of other-end retaining elements 72, and a plurality of hanging portions 80 as elements for retaining the outdoor heat exchanger 30 to the body frame 20. The one-end retaining elements 71 are attached to one end of the outdoor heat exchanger 30. The other-end retaining elements 72 are attached to the other end of the outdoor heat exchanger 30. The hanging portions 80 each include a first hanger element 81 and a second hanger element 82. The first hanger element 81 and the second hanger element 82 are attached to an upper part of the outdoor heat exchanger 30.

FIG. 3 illustrates a case in which two hanging portions 80 are provided on the long-side portion L of the outdoor heat exchanger 30 that is bent in an L shape in plan view. In such a case, the positions of the hanging portions 80 may be determined such that the distance between the two positions does not exceed 600 mm.

Figure 4:
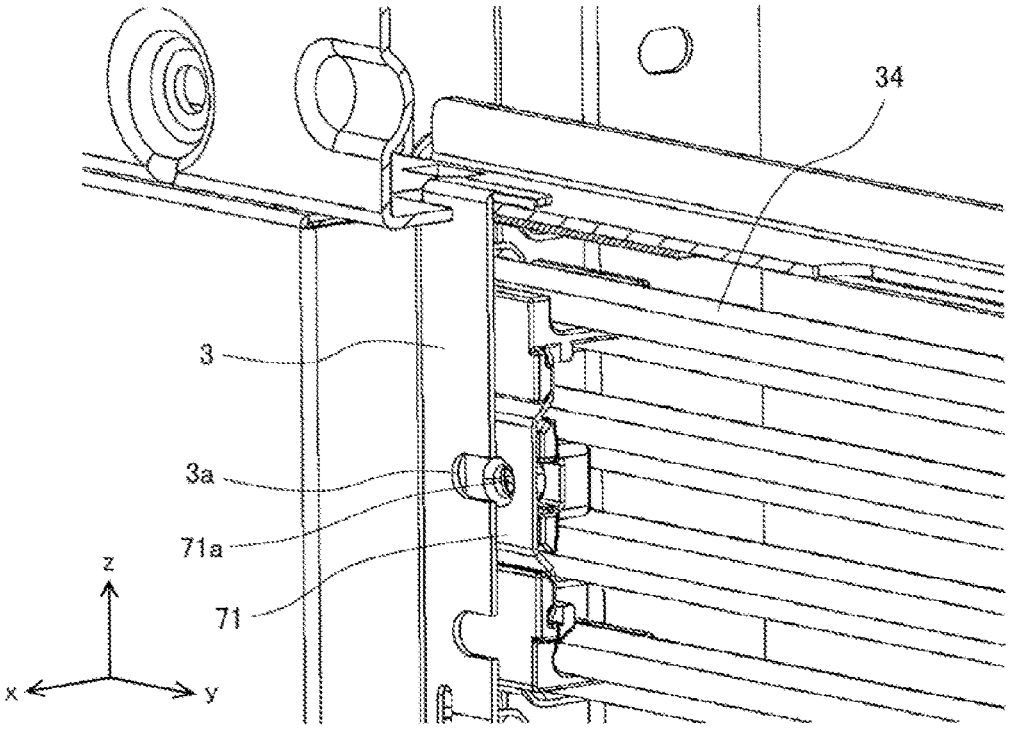
FIG. 4 is an enlarged view illustrating a configuration around one of one-end retaining elements illustrated in FIG. 3.
Figure 5:
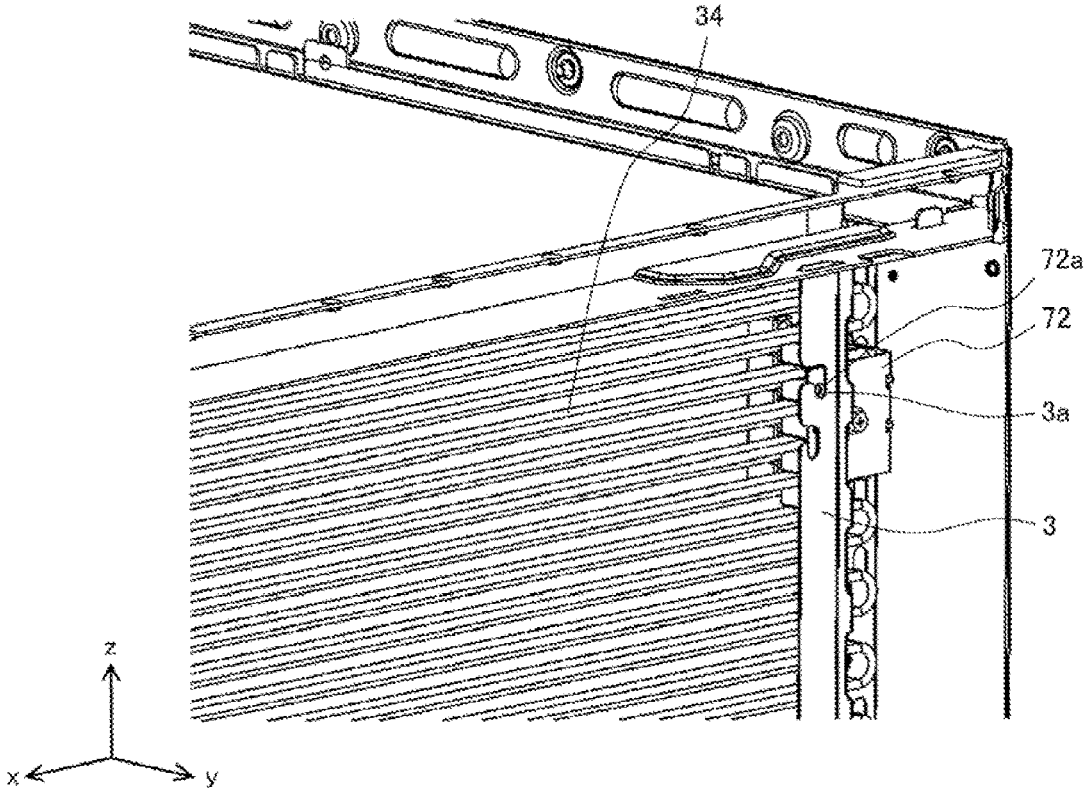
FIG. 5 is an enlarged view illustrating a configuration around one of other-end retaining elements illustrated in FIG. 3.

FIG. 4 is an enlarged view illustrating a configuration around one of the one-end retaining elements illustrated in FIG. 3. FIG. 5 is an enlarged view illustrating a configuration around one of the other-end retaining elements illustrated in FIG. 3. FIG. 4 illustrates the positional relationship between the one-end retaining element 71 and a corresponding one of the pillars 3 to which the one-end retaining element 71 is fixed. FIG. 5 illustrates the positional relationship between the other-end retaining element 72 and a corresponding one of the pillars 3 to which the other-end retaining element 72 is fixed. Note that the fins 34*f* are not illustrated in FIGS. 4 and 5, omission of illustration of the fins 34*f* also applies to the other drawings to be referred to below.

As illustrated in FIGS. 4 and 5, the one-end retaining element 71 and the other-end retaining element 72 are retained to corresponding ones of the pillars 3 provided at the four corners of the body frame 20. The one-end retaining element 71 is fastened to the pillar 3 at a cut 3*a* of the pillar 3 by using a screw, with some heat exchanger tubes 34 being supported by the one-end retaining element 71. The other-end retaining element 72 is fastened to the pillar 3 at a cut 3*a* of the pillar 3 by using a screw, with some heat exchanger tubes 34 being supported by the other-end retaining element 72. While FIG. 4 illustrates a case where the pillar 3 has the cut 3*a*, this is not restrictive. Instead of the cut 3*a*, the pillar 3 may have a hole through which a screw is insertable.

Figure 6:
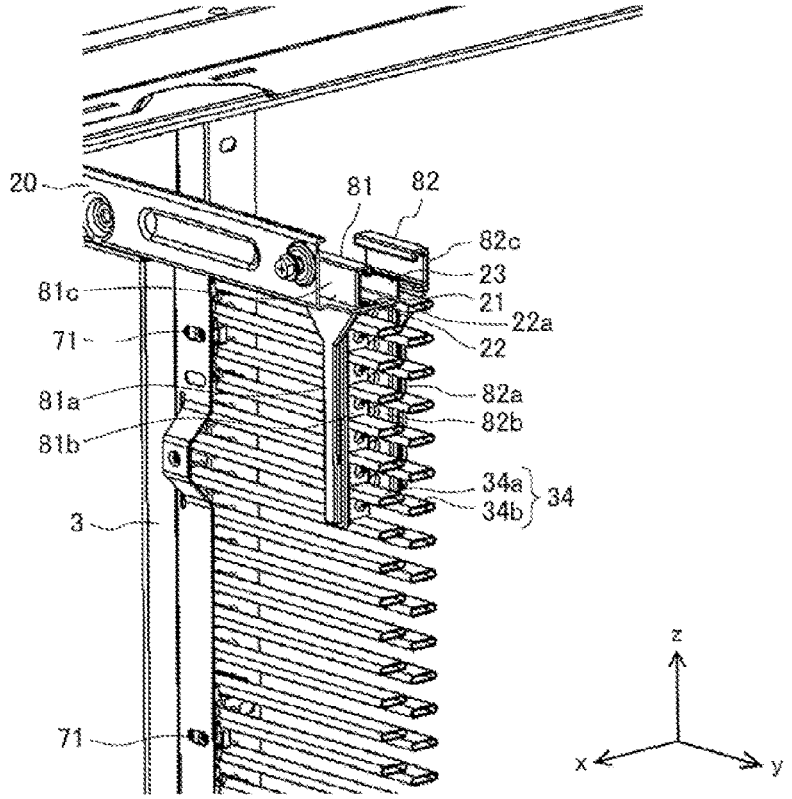
FIG. 6 is a schematic diagram illustrating part of a configuration in which a first heat exchanger and a second heat exchanger are attached to an upper part of a body frame of the outdoor unit illustrated in FIG. 1.
Figure 7:
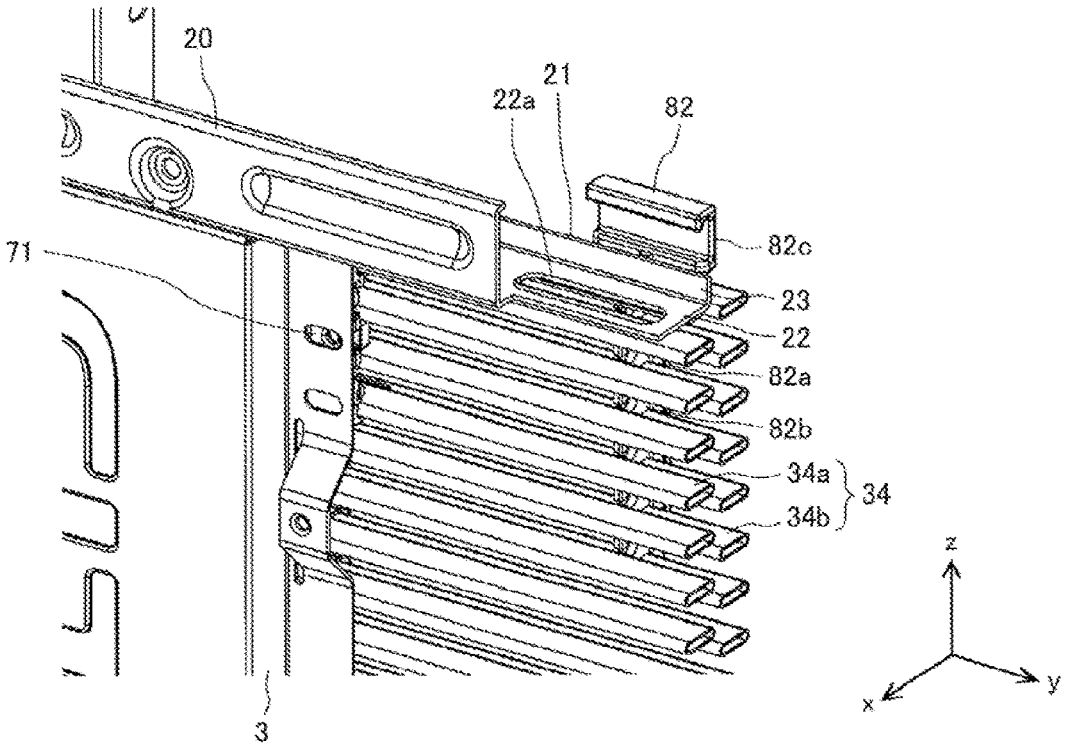
FIG. 7 is an enlarged view illustrating a configuration around a hanger-receiving portion illustrated in FIG. 6.

FIG. 6 is a schematic diagram illustrating part of a configuration in which the first heat exchanger and the second heat exchanger are attached to an upper part of the body frame of the outdoor unit illustrated in FIG. 1. FIG. 7 is an enlarged view illustrating a configuration around a hanger-receiving portion illustrated in FIG. 6. Hereinafter, as illustrated in FIGS. 6 and 7, the heat exchanger tubes 34 of the first heat exchanger 31 are denoted as first heat exchanger tubes 34*a*, and the heat exchanger tubes 34 of the second heat exchanger 32 are denoted as second heat exchanger tubes 34*b*. Note that the first hanger element 81 is not illustrated in FIG. 7.

As illustrated in FIGS. 6 and 7, the body frame 20 includes a hanger-receiving portion 21 in the upper part thereof. The hanger-receiving portion 21 is provided for supporting the outdoor heat exchanger 30 through the first hanger element 81, the second hanger element 82, and a connecting element 75 to be described below. The hanger-receiving portion 21 has an L shape in sectional view. The hanger-receiving portion 21 includes a beam-like supporting part 22 extending in the horizontal direction, and a restricting part 23 extending upward from an end of the supporting part 22. The supporting part 22 has an insertion hole 22*a* into which the first hanger element 81 is inserted. The restricting part 23 restricts at least the movement of the connecting element 75 in a direction from a corresponding one of the air inlets 11 toward the outdoor heat exchanger 30.

Figure 8:
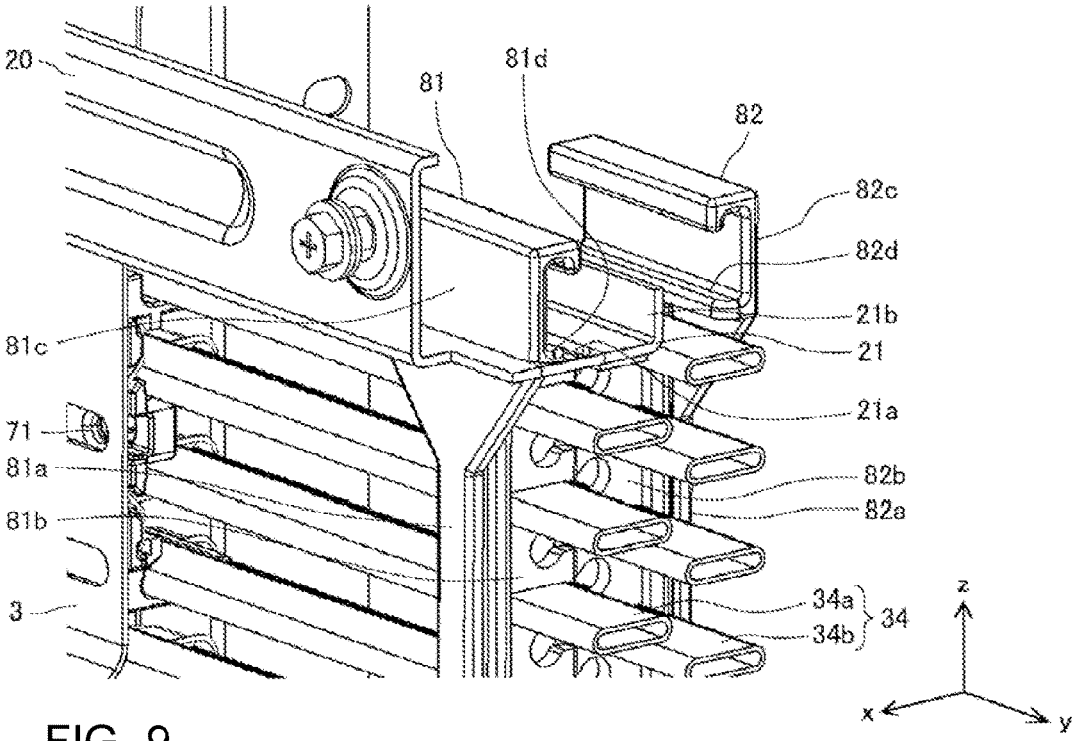
FIG. 8 is an enlarged view illustrating the positional relationship among a first hanger element, a second hanger element, and the hanger-receiving portion illustrated in FIG. 6.

FIG. 8 is an enlarged view illustrating the positional relationship among the first hanger element 81, the second hanger element 82, and the hanger-receiving portion 21 illustrated in FIG. 6. The first hanger element 81 includes a stem portion 81*a*, a heat-exchanger-tube-engaging portion 81*b*, a locking portion 81*c*, and a guiding portion 81*d*. The stem portion 81*a* has a pillar shape. The heat-exchanger-tube-engaging portion 81*b* is connected to the stem portion 81*a* and engages with some first heat exchanger tubes 34*a*. Note that the first heat exchanger tubes 34*a* are a plurality of heat exchanger tubes extending from one end to the other end of the first heat exchanger 31 and arranged side by side in the height direction. Hence, the heat-exchanger-tube-engaging portion 81*b* has such a shape as to engage with adjacent two or more of the plurality of heat exchanger tubes forming the first heat exchanger tubes 34*a* and arranged side by side in the height direction. More specifically, the heat-exchanger-tube-engaging portion 81*b* includes a plurality of elements that are arranged side by side in the height direction such that some of the plurality of heat exchanger tubes forming the first heat exchanger tubes 34*a* are each held between adjacent ones of the plurality of elements.

The locking portion 81*c* extends in the height direction from the stem portion 81*a* and has a hook-like shape. The locking portion 81*c* bears the weight of the locking portion 81*c* itself and the load of the first heat exchanger 31. The guiding portion 81*d* projects at the boundary between the stem portion 81*a* and the locking portion 81*c* and extends in the horizontal direction so as to guide the connecting element 75. Thus, the first hanger element 81 engages with the first heat exchanger 31 and is attached to the first heat exchanger 31 as illustrated in FIG. 8.

The second hanger element 82 includes a stem portion 82*a*, a heat-exchanger-tube-engaging portion 82*b*, a locking portion 82*c*, and a guiding portion 82*d*. The stem portion 82*a* has a pillar shape. The heat-exchanger-tube-engaging portion 82*b* is connected to the stem portion 82*a* and engages with some second heat exchanger tubes 34*b*. Note that the second heat exchanger tubes 34*b* are a plurality of heat exchanger tubes extending from one end to the other end of the second heat exchanger 32 and arranged side by side in the height direction. Hence, the heat-exchanger-tube-engaging portion 82*b* has such as shape as to engage with adjacent two or more of the plurality of heat exchanger tubes forming the second heat exchanger tubes 34*b* and arranged side by side in the height direction. More specifically, the heat-exchanger-tube-engaging portion 82*b* includes a plurality of elements that are arranged side by side in the height direction such that some of the plurality of heat exchanger tubes forming the second heat exchanger tubes 34*b* are each held between adjacent ones of the plurality of elements.

The locking portion 82*c* extends in the height direction from the stem portion 82*a* and has a hook shape. The locking portion 82*c* bears the weight of the locking portion 82*c* itself and the load of the second heat exchanger 32. The guiding portion 82*d* projects at the boundary between the stem portion 82*a* and the locking portion 82*c* and extends in the horizontal direction so as to guide the connecting element 75. Thus, the second hanger element 82 engages with the second heat exchanger 32 and is attached to the second heat exchanger 32 as illustrated in FIG. 8.

Figure 9:
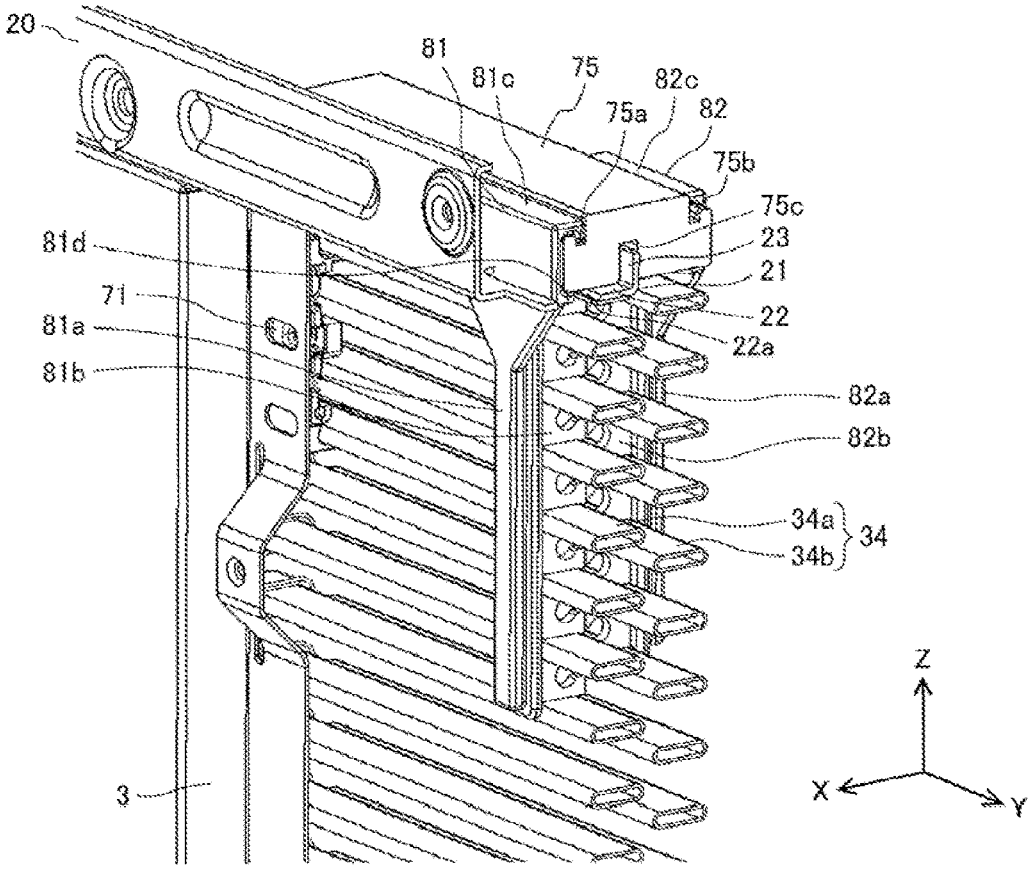
FIG. 9 is a perspective view illustrating a state where the hanger-receiving portion, the first hanger element, and the second hanger element illustrated in FIG. 8 are connected to one another by a connecting element.

FIG. 9 is a perspective view illustrating a state where the hanger-receiving portion, the first hanger element, and the second hanger element illustrated in FIG. 8 are connected to one another by the connecting element. As illustrated in FIG. 9, the outdoor unit 100 includes the connecting element 75 that connects the hanger-receiving portion 21 to the first hanger element 81 and the second hanger element 82. The connecting element 75 has a first groove 75*a* in which the distal end of the locking portion 81*c* is fitted, a second groove 75*b* in which the distal end of the locking portion 82*c* is fitted, and a third groove 75*c* in which the restricting part 23 is fitted. Part of the lower surface of the connecting element 75 is in contact with the guiding portion 81*d* and the supporting part 22.

The connecting element 75 is inserted into a space (see FIG. 8) defined by the hanger-receiving portion 21, the first hanger element 81, and the second hanger element 82 from the right side, which is the positive side of the y axis, or from the left side, which is the negative side of the y axis, thereby fitted in the space as illustrated in FIG. 9. Thus, the outdoor heat exchanger 30 is supported by the hanger-receiving portion 21 through the hanging portion 80 and the connecting element 75.

Figure 10:
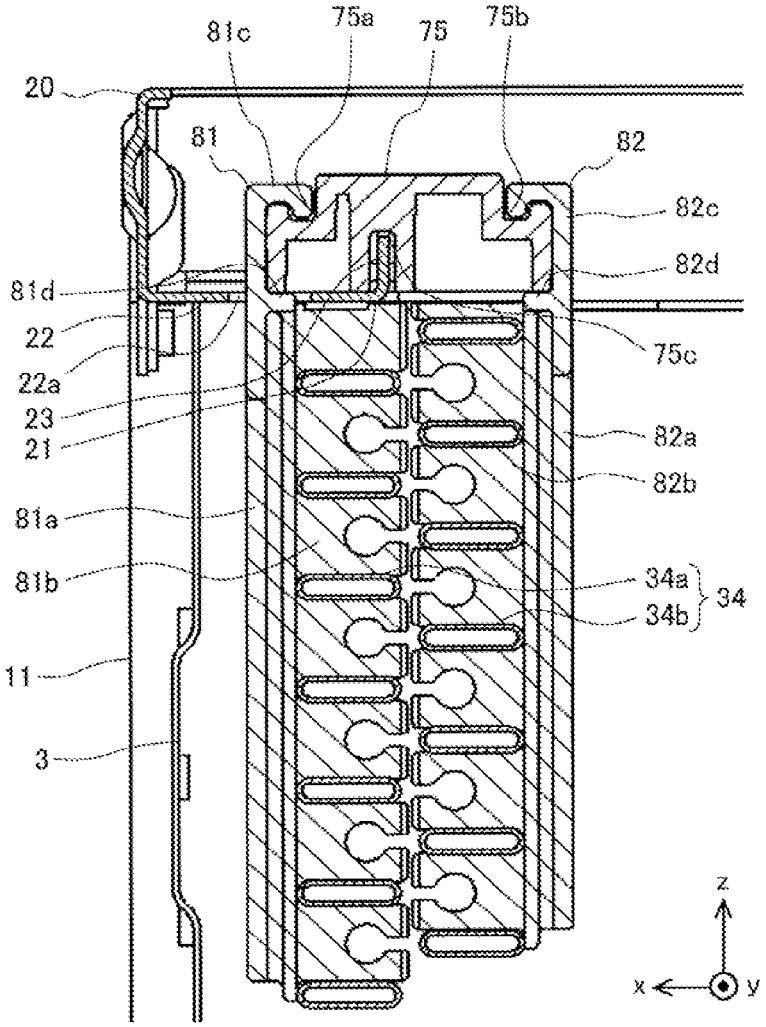
FIG. 10 is a sectional view schematically illustrating a part around the connecting element illustrated in FIG. 9.

FIG. 10 is a sectional view schematically illustrating a part around the connecting element illustrated in FIG. 9. As illustrated in FIG. 10, the distal end of the locking portion 81*c* is fitted in the first groove 75*a*. Therefore, the first hanger element 81 can be stably fixed to the connecting element 75. Furthermore, the distal end of the locking portion 82*c* is fitted in the second groove 75*b*. Therefore, the second hanger element 82 can be stably fixed to the connecting element 75. Furthermore, the restricting part 23 is fitted in the third groove 75*c*. Therefore, the movement of the connecting element 75 in a direction toward the positive side of the x axis and in a direction toward the negative side of the x axis can be restricted. Herein, the direction toward the negative side of the x axis is a direction from the air inlet 11 toward the outdoor heat exchanger 30. When the connecting element 75 is inserted into the space defined by the hanger-receiving portion 21 and the hanging portion 80, the connecting element 75 is guided by the distal end of the locking portion 81*c*, the guiding portion 81*d*, the hanger-receiving portion 21, the distal end of the locking portion 82*c*, and the guiding portion 82*d*.

Figure 11:
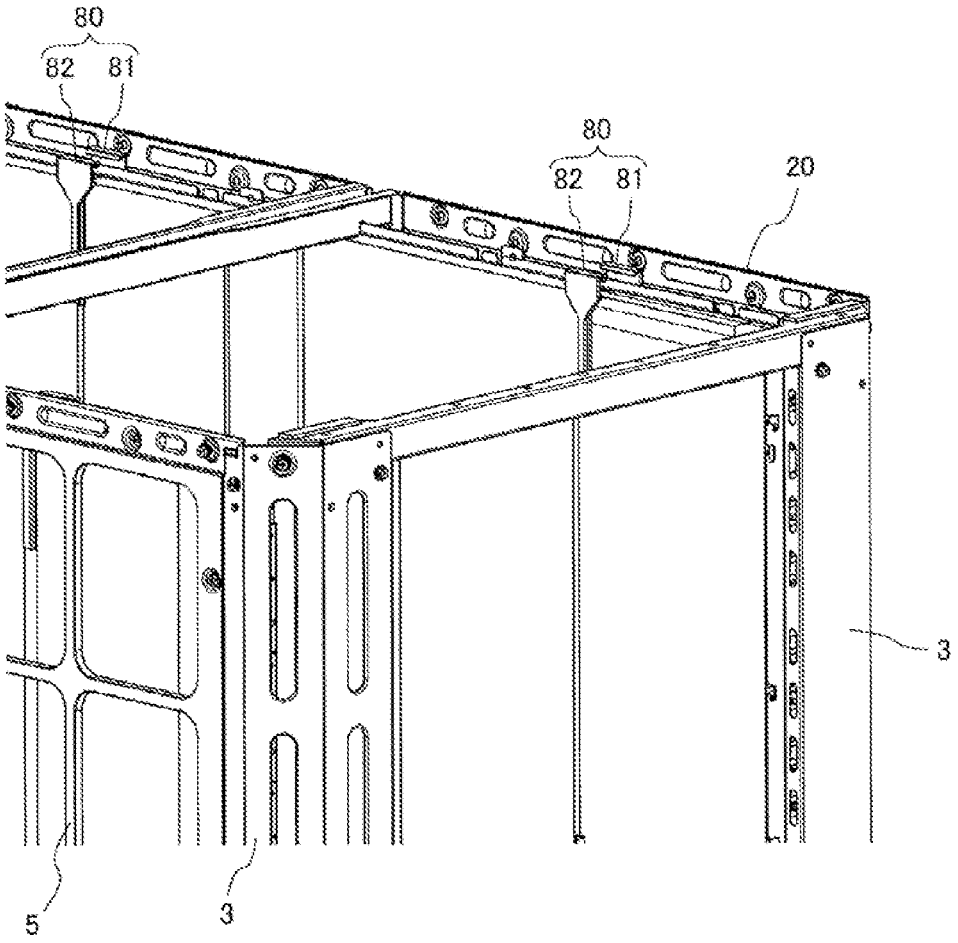
FIG. 11 is a perspective view illustrating a hanging portion provided on a rear face of the body casing illustrated in FIG. 1.

FIG. 11 is a perspective view illustrating another hanging portion provided on the rear face of the body casing illustrated in FIG. 1. A corresponding outdoor heat exchanger 30 and a corresponding connecting element 75 are not illustrated in FIG. 11. The above description given with reference to FIGS. 3 to 10 concerns one of the heat exchangers included in the outdoor heat exchanger 30 that extends along the front face and the right side face of the outdoor unit 100. The heat exchanger extending along the rear face and the left side face of the outdoor unit 100 is also supported by a hanger-receiving portion 21 with the aid of a hanging portion 80 and a connecting element 75. That is, in the outdoor unit 100, the hanging portion 80 including the first hanger element 81 and the second hanger element 82 is also provided near the hanger-receiving portion 21 on the rear side. Furthermore, the connecting element 75, not illustrated in FIG. 11, is fitted in the space defined by the hanger-receiving portion 21, the first hanger element 81, and the second hanger element 82. Thus, the outdoor heat exchanger 30 that extends along the rear face and the left side face of the outdoor unit 100 is supported by the hanger-receiving portion 21 through the hanging portion 80 and the connecting element 75.

As described above, in the outdoor unit 100, the hanger-receiving portion 21 provided in the upper part of the body frame 20 and the hanging portion 80 engaging with the outdoor heat exchanger 30 are connected to each other by the connecting element 75. Thus, the outdoor heat exchanger 30 can be supported in a hanging manner. Therefore, deformation of the outdoor heat exchanger 30 due to vibrations or any other reason that may occur during transportation can be suppressed, and the occurrence of various problems triggered by supporting the heat exchanger from below can be suppressed.

For example, in a configuration in which the outdoor heat exchanger 30 is supported only at the ends thereof, a central part of the outdoor heat exchanger 30 in the width direction from one end to the other end may bend to contact other components, leading to deformation of components such as the fins 34*f* and the heat exchanger tubes 34. In this respect, in the outdoor unit 100 according to Embodiment 1, the outdoor heat exchanger 30 is supported by the hanger-receiving portion 21 through the hanging portion 80 and the connecting element 75. Therefore, the bending of the width-direction central part of the outdoor heat exchanger 30 can be prevented. Consequently, deformation of components such as the fins 34*f* and the heat exchanger tubes 34 can be suppressed. Furthermore, the outdoor unit 100 employs the configuration of supporting the outdoor heat exchanger 30 in a hanging manner. Therefore, the outdoor heat exchanger 30 does not need to be placed on a seat. Consequently, buckling deformation of the fins 34*f* at the bottom of the outdoor heat exchanger 30 can be prevented, and the drainage of dew water and the like resulting from heat exchange can be improved. Thus, in the outdoor unit 100, while the outdoor heat exchanger 30 is positioned in an upper part of the body thereof in the height direction, problems such as deformation of the outdoor heat exchanger 30 can be suppressed.

In addition, the outdoor heat exchanger 30 of the outdoor unit 100 is fixed to the pillars 3 at the two ends thereof by using the one-end retaining element 71 and the other-end retaining element 72. Therefore, the load of supporting the outdoor heat exchanger 30 can be distributed between the two ends and the upper part. Hence, the outdoor heat exchanger 30 can be stably supported. Consequently, deformation of the outdoor heat exchanger 30 can be suppressed more effectively. On the other hand, a drain pan (not illustrated) that guides drain water generated on the outdoor heat exchanger 30 of the outdoor unit 100 is provided below the outdoor heat exchanger 30. In this respect, the outdoor heat exchanger 30 of the outdoor unit 100 does not need to be placed on the drain pan because the outdoor heat exchanger 30 is supported by using the one-end retaining element 71, the other-end retaining element 72, the first hanger element 81, and the second hanger element 82. Accordingly, the bottom of the outdoor heat exchanger 30 is prevented from bringing into contact with the drain pan. Consequently, good drainage is assured.

The hanger-receiving portion 21 has the insertion hole 22*a* for preventing contact with the first hanger element 81. The insertion hole 22*a* may be replaced with a cut for preventing contact with the first hanger element 81. Alternatively, the hanger-receiving portion 21 may have neither the insertion hole 22*a* nor the cut, depending on the state of connection to the hanging portion 80. That is, the first hanger element 81 and the second hanger element 82 may be directly retained by the hanger-receiving portion 21. For example, the connecting element 75 may is adhesive. In that case, the first hanger element 81 and the second hanger element 82 are pasted to the hanger-receiving portion 21, whereby the hanger-receiving portion 21 and the hanging portion 80 are connected to each other. As another alternative, the connecting element 75 may be a fastening element such as a screw. In that case, the first hanger element 81 and the second hanger element 82 are fastened to the hanger-receiving portion 21 by using the fastening element, whereby the hanger-receiving portion 21 and the hanging portion 80 are connected to each other. Such a method increases the flexibility in designing the configuration of hanging the outdoor heat exchanger 30 and reduces the area where the flow path of the air is blocked.

FIG. 3 illustrates one of the hanging portions 80 (the hanging portion 80 on the positive side of the y axis) that is provided at a central part of the outdoor heat exchanger 30 in the width direction from one end to the other end. If the outdoor heat exchanger 30 is supported at such a width-direction central part, the bending of the outdoor heat exchanger 30 in the vertical direction can be suppressed. Furthermore, such a positional relationship among the hanging portion 80, the one-end retaining element 71, and the other-end retaining element 72 disperses the load of supporting the outdoor heat exchanger 30 in a well-balanced manner. Therefore, the outdoor heat exchanger 30 can be supported more stably.

Needless to say, while FIG. 3 illustrates a case where two hanging portions 80 are provided, it is not restrictive. The outdoor unit 100 may include a single hanging portion 80 or three or more hanging portions 80. Moreover, the hanging portion 80 may be provided on the short-side portion S of the outdoor heat exchanger 30. That is, the outdoor heat exchanger 30 of the outdoor unit 100 may be supported in a hanging manner by the hanger-receiving portion 21 through a single or a plurality of hanging portions 80 and a single or a plurality of connecting elements 75 at a single or a plurality of positions. Needless to say, if a plurality of hanging portions 80 are used, the load of supporting the outdoor heat exchanger 30 can be dispersed among more points. Therefore, the outdoor heat exchanger 30 can be supported more stably. Consequently, deformation of the outdoor heat exchanger 30 can be suppressed more precisely.

Embodiment 2

An overall configuration of an outdoor unit for an air-conditioning apparatus according to Embodiment 2 is the same as the air-conditioning apparatus 300 described with reference to FIGS. 1 and 2, and no drawings and description thereof are provided but the same reference numerals are used. Elements that are the same as those described in Embodiment 1 are denoted by corresponding ones of the reference numerals, and description of such elements is omitted.

Figure 12:
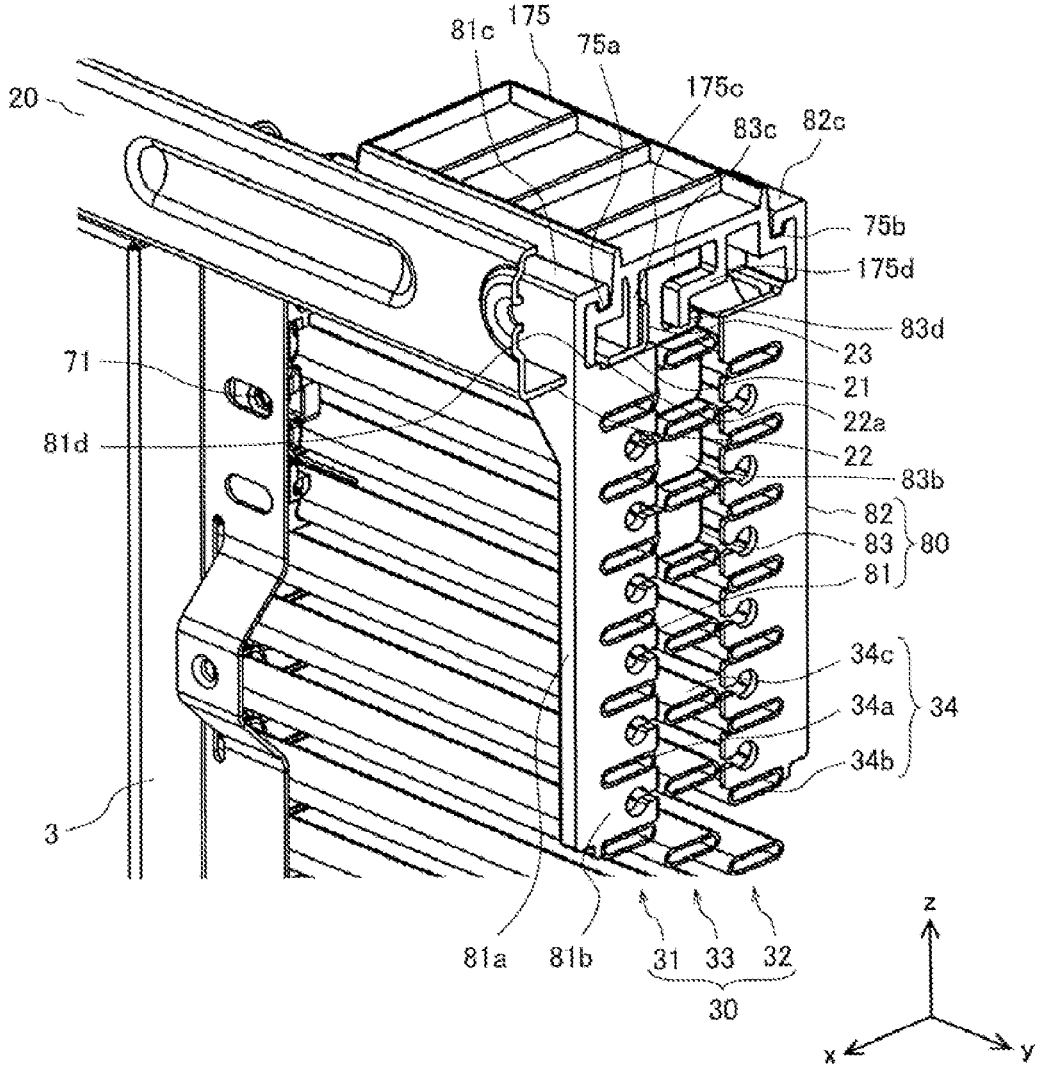
FIG. 12 is a perspective view concerning the outdoor unit for an air-conditioning conditioning apparatus according to Embodiment 2 of the present invention and illustrates a state where the hanger-receiving portion, the first hanger element, the second hanger element, and a third hanger element are connected to one another by the connecting element.

FIG. 12 is a perspective view concerning the outdoor unit for an air-conditioning conditioning apparatus according to Embodiment 2 of the present invention and illustrates a state where the hanger-receiving portion, the first hanger element, the second hanger element, and a third hanger element are connected to one another by the connecting element. For easy understanding of the configuration, some elements such as the fins 34*f* are not illustrated in FIG. 12, which also applies to the other drawings to be referred to below.

As illustrated in FIG. 12, the outdoor heat exchanger 30 according to Embodiment 2 includes a third heat exchanger 33 to improve heat-exchanging performance. The third heat exchanger 33 is provided between the first heat exchanger 31 and the second heat exchanger 32 and extends along the inner surface of the first heat exchanger 31. Furthermore, the hanging portion 80 according to Embodiment 2 includes a third hanger element 83 that engages with the third heat exchanger 33. Furthermore, the outdoor unit 100 according to Embodiment 2 includes a connecting element 175 that connects the hanger-receiving portion 21, the first hanger element 81, the second hanger element 82, and the third hanger element 83 to one another. The third heat exchanger 33 includes third heat exchanger tubes 34*c* as a plurality of heat exchanger tubes extending from one end to the other end of the third heat exchanger 33 and arranged side by side in the height direction.

The third hanger element 83 is held between the first heat exchanger tubes 34*a* of the first heat exchanger 31 and the third heat exchanger tubes 34*c* of the third heat exchanger 33. The third hanger element 83 includes a heat-exchanger-tube-engaging portion 83*b*, a retaining portion 83*c*, and a guiding portion 83*d*. The heat-exchanger-tube-engaging portion 83*b* engages with the third heat exchanger tubes 34*c*. More specifically, the heat-exchanger-tube-engaging portion 83*b* has such a shape as to engage with adjacent two or more of the plurality of heat exchanger tubes forming the third heat exchanger tubes 34*c* and arranged side by side in the height direction. More specifically, the heat-exchanger-tube-engaging portion 83*b* includes a plurality of elements that are arranged side by side in the height direction such that some of the plurality of heat exchanger tubes forming the third heat exchanger tubes 34*c* are each held between adjacent ones of the plurality of elements. Furthermore, the third hanger element 83 is configured such that the uppermost one of the third heat exchanger tubes 34*c* is held between the uppermost one of the plurality of elements included in the heat-exchanger-tube-engaging portion 83*b* and the guiding portion 83*d*.

The retaining portion 83*c* extends in the height direction from the heat-exchanger-tube-engaging portion 83*b* and has a catch shape. The retaining portion 83*c* bears the weight of the retaining portion 83*c* itself and the load of the third heat exchanger 33. The guiding portion 83*d* projects at the boundary between the heat-exchanger-tube-engaging portion 83*b* and the retaining portion 83*c* and extends in the horizontal direction so as to guide the connecting element 175. Thus, the third hanger element 83 engages with the third heat exchanger 33 and is attached to the third heat exchanger 33 as illustrated in FIG. 12.

The connecting element 175 includes a restricting wall 175*c* positioned adjacent to the restricting part 23, and an engaging portion 175*d* engaging with the retaining portion 83*c*. Part of the lower surface of the connecting element 175 is in contact with the guiding portion 81*d* and the supporting part 22. More specifically, in the connecting element 175, the lower end of a side wall that is in parallel to the outdoor heat exchanger 30 is in contact with the upper surface of the guiding portion 81*d*, and the lower end of the restricting wall 175*c* is in contact with the upper surface of the supporting part 22.

The connecting element 175 is inserted into a space defined by the hanger-receiving portion 21, the first hanger element 81, the second hanger element 82, and the third hanger element 83 from the positive side of the y axis or from the negative side of they axis, thereby being fitted in the space as illustrated in FIG. 12.

Figure 13:
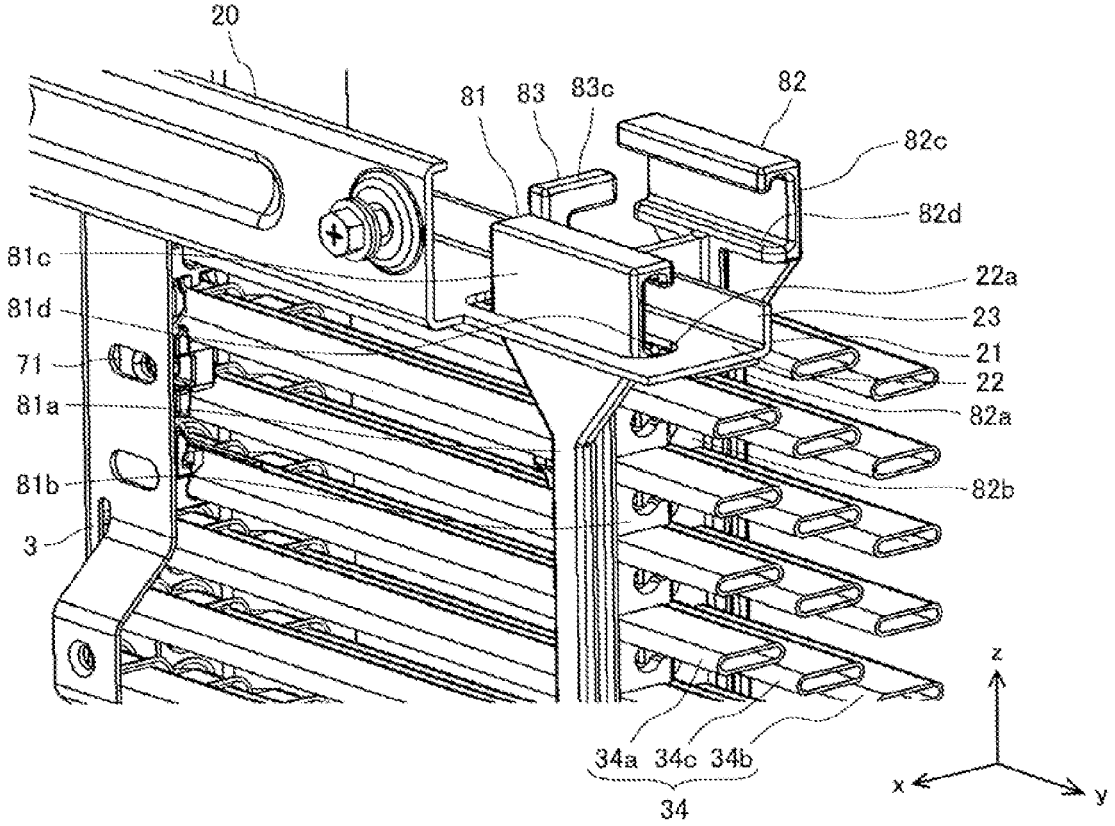
FIG. 13 is an enlarged view illustrating the positional relationship among the first hanger element, the second hanger element, the third hanger element, and the hanger-receiving portion illustrated in FIG. 12.
Figure 14:
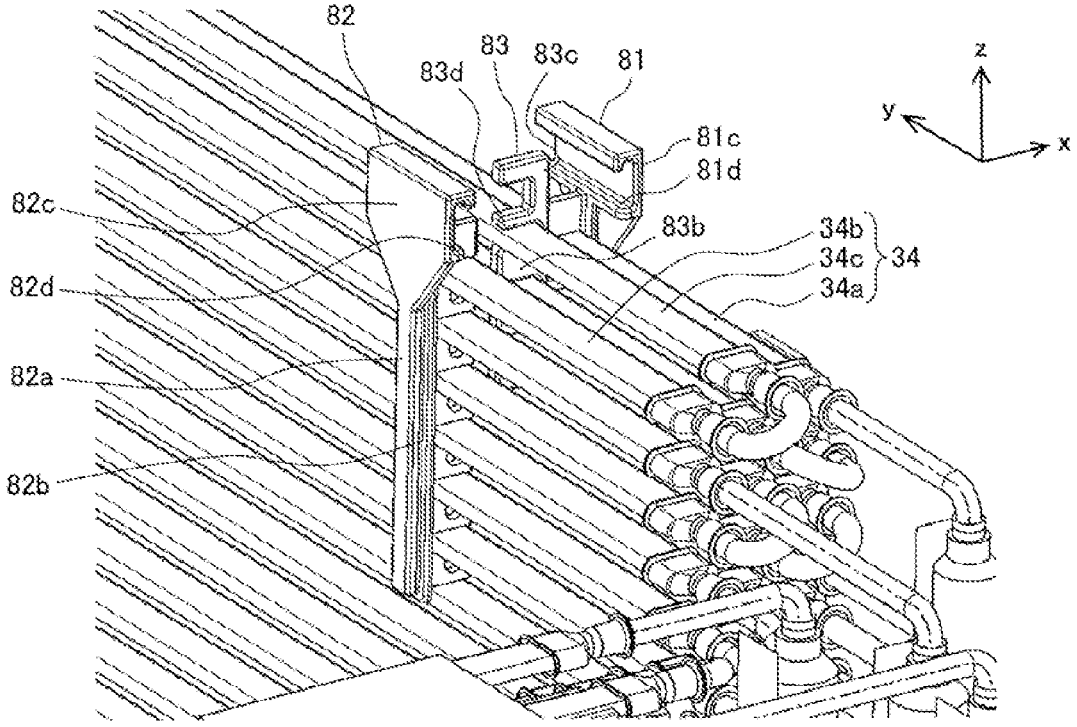
FIG. 14 is a perspective view illustrating the positional relationship among the first hanger element, the second hanger element, the third hanger element, and heat exchanger tubes illustrated in FIG. 12.

FIG. 13 is an enlarged view illustrating the positional relationship among the first hanger element, the second hanger element, the third hanger element, and the hanger-receiving portion illustrated in FIG. 12. FIG. 14 is a perspective view illustrating the positional relationship among the first hanger element, the second hanger element, the third hanger element, and the heat exchanger tubes illustrated in FIG. 12. The view illustrated in FIG. 14 is seen from a side opposite to the side from which the first hanger element 81, the second hanger element 82, and the third hanger element 83 are seen in FIG. 13. As illustrated in FIGS. 13 and 14, the third hanger element 83 is held between the first heat exchanger tubes 34*a* of the first heat exchanger 31 and the third heat exchanger tubes 34*c* of the third heat exchanger 33.

Figure 15:
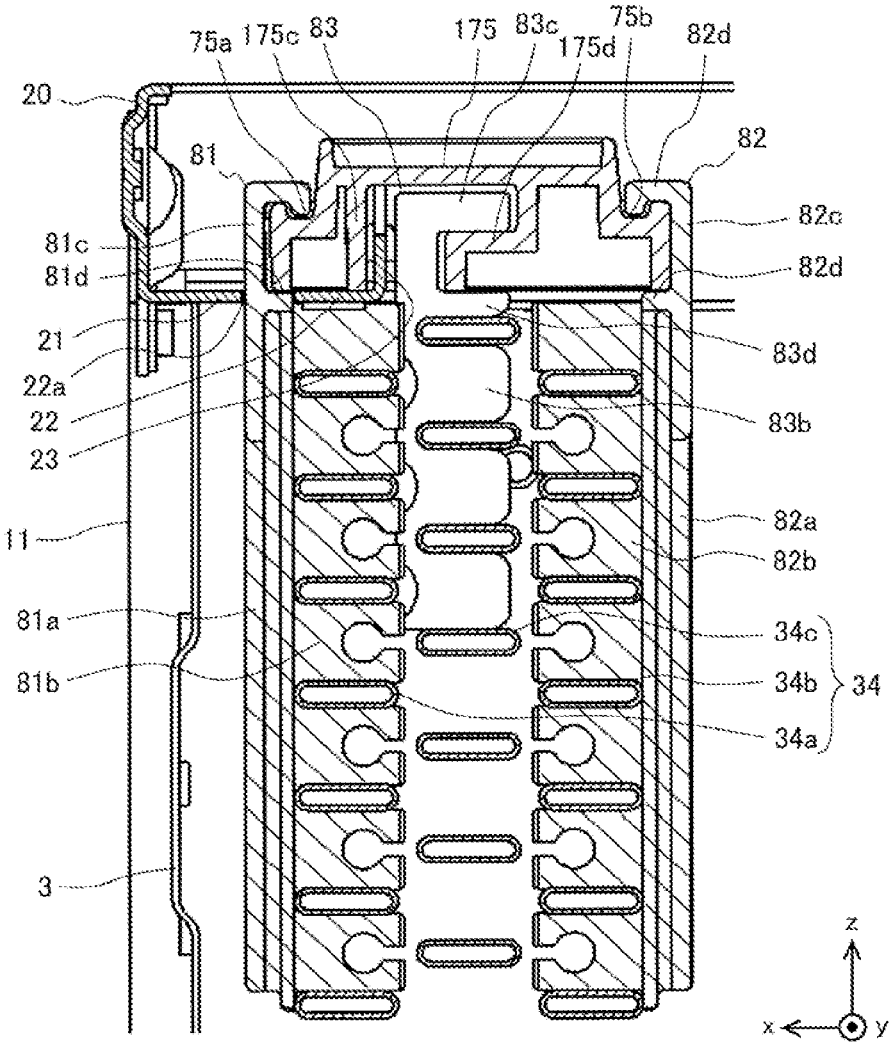
FIG. 15 is a sectional view schematically illustrating a part around the connecting element illustrated in FIG. 12.

FIG. 15 is a sectional view schematically illustrating a part around the connecting element illustrated in FIG. 12. As illustrated in FIG. 15, the distal end of the locking portion 81*c* is fitted in the first groove 75*a*. Therefore, the first hanger element 81 can be stably fixed to the connecting element 175. Furthermore, the distal end of the locking portion 82*c* is fitted in the second groove 75*b*. Therefore, the second hanger element 82 can be stably fixed to the connecting element 175. Furthermore, the restricting part 23 is positioned adjacent to the restricting wall 175*c*. Therefore, the movement of the connecting element 175 in a direction from the air inlet 11 toward the outdoor heat exchanger 30 can be restricted. When the connecting element 175 is inserted into the space defined by the hanger-receiving portion 21 and the hanging portion 80, the connecting element 175 is guided by the distal end of the locking portion 81*c*, the guiding portion 81*d*, the hanger-receiving portion 21, the guiding portion 83*d*, the distal end of the locking portion 82*c*, and the guiding portion 82*d*.

As described above, in the outdoor unit 100 according to Embodiment 2, the hanger-receiving portion 21 provided in the upper part of the body frame 20 and the hanging portion 80 engaging with the outdoor heat exchanger 30 are connected to each other by the connecting element 175. Thus, the outdoor heat exchanger 30 can be supported in a hanging manner. Therefore, deformation of the outdoor heat exchanger 30 due to vibrations or any other reason that may occur during transportation can be suppressed, and the occurrence of various problems triggered by supporting the heat exchanger from below can be suppressed.

The outdoor heat exchanger 30 according to Embodiment 2 includes three heat exchangers arranged in the direction in which the air suctioned in from the air inlet 11 flows. Hence, an increased area of heat exchange is provided near the fans 50. Therefore, efficient heat exchange can be realized. In the known art, it is difficult to add a supporting structure to a compound heat exchanger including three heat exchangers arranged side by side. In contrast, in the outdoor unit 100 according to Embodiment 2, the outdoor heat exchanger 30 can be easily supported in a hanging manner with the incorporation of the third hanger element 83. Moreover, another hanger element having the same shape as the third hanger element 83 may be added. Furthermore, if the shape of the connecting element 175 is changed in accordance with the number, the shape, and the positional relationship of hanger elements, an outdoor heat exchanger 30 including four or more heat exchangers arranged side by side can also be supported in a hanging manner. That is, even if the outdoor unit 100 includes an outdoor heat exchanger 30 formed of three or four heat exchangers arranged side by side, deformation of the outdoor heat exchanger 30 due to vibrations or any other reason that may occur during transportation can be suppressed. Furthermore, since no elements are in contact with the bottom of the outdoor heat exchanger 30, good drainage is realized. Other advantageous effects or features are the same as those produced in Embodiment 1.

The hanger-receiving portion 21 has the insertion hole 22*a* for preventing contact with the first hanger element 81. The insertion hole 22*a* may be replaced with a cut for preventing contact with the first hanger element 81. Alternatively, the hanger-receiving portion 21 may have neither the insertion hole 22*a* nor the cut, depending on the state of connection to the hanging portion 80. That is, the first hanger element 81, the second hanger element 82, and the third hanger element 83 may be directly retained to the hanger-receiving portion 21. For example, the connecting element 175 may be adhesive. In that case, the first hanger element 81, the second hanger element 82, and the third hanger element 83 are pasted to the hanger-receiving portion 21, whereby the hanger-receiving portion 21 and the hanging portion 80 are connected to each other. As another alternative, the connecting element 175 may be a fastening element such as a screw. In that case, the first hanger element 81, the second hanger element 82, and the third hanger element 83 are fastened to the hanger-receiving portion 21 by using the fastening element, whereby the hanger-receiving portion 21 and the hanging portion 80 are connected to each other. Such a method increases the flexibility in designing the configuration of hanging the outdoor heat exchanger 30 and reduces the area where the flow path of the air is blocked.

FIGS. 12 to 15 illustrate a case where the third hanger element 83 is held between the first heat exchanger tubes 34*a* of the first heat exchanger 31 and the third heat exchanger tubes 34*c* of the third heat exchanger 33, but these are not restrictive. The third hanger element 83 may be held between the second heat exchanger tubes 34*b* of the second heat exchanger 32 and the third heat exchanger tubes 34*c* of the third hanger element 83. That is, the third hanger element 83 may be inverted relative to the z axis. In that case, the engaging portion 175*d* is shaped in conformity with the retaining portion 83*c*.

<Modifications>

Figure 16:
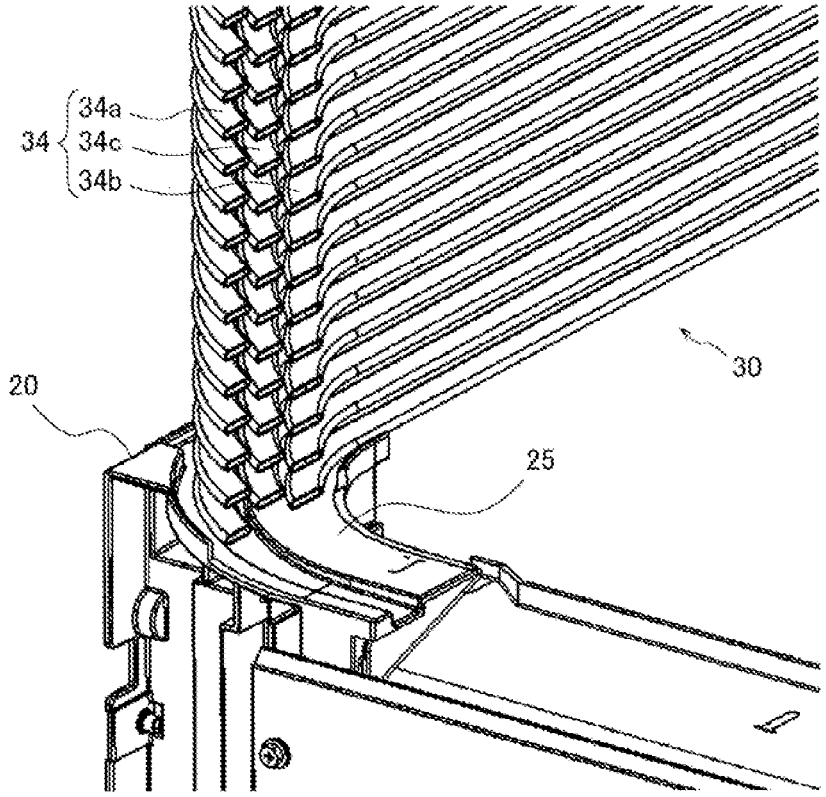
FIG. 16 illustrates a configuration according to a modification of Embodiment 2 of the present invention.

FIG. 16 illustrates a configuration according to a modification of Embodiment 2 of the present invention. Embodiments 1 and 2 each relate to a case where the outdoor heat exchanger 30 is supported in a hanging manner at the upper part thereof. In addition, the outdoor heat exchanger 30 may be supported at part of a side face or the bottom thereof. For example, as illustrated in FIG. 16, the body frame 20 may include a foundation 25 that supports part of the bottom of the outdoor heat exchanger 30. As illustrated in FIG. 16, for example, the boundary between the long-side portion L and the short-side portion S, that is, the bent part having relatively high strength, may be supported by the foundation 25.

If the number of points of supporting the outdoor heat exchanger 30 is increased as described above, the supporting load can further be dispersed. Accordingly, deformation of the outdoor heat exchanger 30 due to vibrations or any other reason that may occur during transportation can further be suppressed. Needless to say, if a configuration of supporting the bottom of the outdoor heat exchanger 30 is employed, frosting may occur because of poor drainage. Such frost needs to be melted and drained. Accordingly, for example, the foundation 25 may be made of a material having low thermal conductivity so that no frost is generated. Examples of the material having low thermal conductivity include resin such as acrylonitrile styrene, and rubber such as ethylene propylene diene. Alternatively, a heater that melts the frost may be provided to the foundation 25.

FIG. 16 illustrates a case where part of the bottom of the outdoor heat exchanger 30 including three heat exchangers is supported by the foundation 25. Alternatively, part of the bottom of the outdoor heat exchanger 30 including two heat exchangers, as described in Embodiment 1, may be supported by the foundation 25.

Embodiments 1 and 2 described above are preferable examples of the outdoor unit for an air-conditioning apparatus, and the technical scope of the present invention is not limited thereto. For example, while Embodiments 1 and 2 each concern the outdoor heat exchanger 30 having an L shape in plan view with one long-side portion L and one short-side portion S, the outdoor heat exchanger 30 may have a U shape in plan view with one long-side portion L and two short-side portions S provided at two respective ends of the long-side portion L. If the outdoor heat exchanger 30 includes a long-side portion L and a short-side portion S, the hanging portion 80 may be provided on an upper part of the long-side portion L. If such an outdoor heat exchanger 30 having a bent shape is supported on a side thereof having a long linear portion, a dispersed component of the supporting load can be efficiently received at the position where the hanging portion 80 is provided.

Furthermore, the positions and the number of hanging portions 80 may be changed appropriately, in accordance with factors such as the weight, the shape, and the size of the outdoor heat exchanger 30. Furthermore, while FIG. 3 illustrates a case where four one-end retaining elements 71, three other-end retaining elements 72, and two hanging portions 80 are provided, the numbers of these elements may be changed appropriately, in accordance with factors such as the weight, the shape, and the size of the outdoor heat exchanger 30. Furthermore, while Embodiments 1 and 2 described above each concern a case where the two ends of the outdoor heat exchanger 30 are fixed to the pillars 3 by using the one-end retaining element 71 and the other-end retaining element 72, it is not restrictive. One of the two ends of the outdoor heat exchanger 30 may be supported by a corresponding one of the one-end retaining element 71 and the other-end retaining element 72.

REFERENCE SIGNS LIST

2 bottom plate 3 pillar 3*a* cut 4*a* front panel 4*b* right side panel 5 fin guard 6 top panel 7 fan guard 10 refrigerant circuit 10*a* refrigerant tube 11 air inlet 12 air outlet 15 four-way valve 20 body frame 21 hanger-receiving portion

22 supporting part 22*a* insertion hole 23 restricting part 25 foundation 30 outdoor heat exchanger 31 first heat exchanger 32 second heat exchanger 33 third heat exchanger 34 heat exchanger tube 34*a* first heat exchanger tube 34*b* second heat exchanger tube 34*c* third heat exchanger tube 34*f* fin 35 header unit 35*a* first header 35*b* second header 36 distributor 40 compressor 41 four-way valve 42 accumulator indoor heat exchanger 44 expansion valve 50 fan 60 controller 71 one-end retaining element 72 other-end retaining element 75, 175 connecting element 75*a* first groove 75*b* second groove 75*c* third groove 80 hanging portion 81 first hanger element 81*a*, 82*a* stem portion 81*b*, 82*b*, 83*b* heat-exchanger-tube-engaging portion 81*c*, 82*c* locking portion 81*d*, 82*d*, 83*d* guiding portion 82 second hanger element 83 third hanger element 83*c* retaining portion 100 outdoor unit 175*c* restricting wall 175*d* engaging portion 200 indoor unit 300 air-conditioning apparatus L long-side portion S short-side portion

The invention claimed is:

1. An outdoor unit for an air-conditioning apparatus, the outdoor unit comprising:

a body frame having, in a side face, an air inlet from which outside air is suctioned, the body frame including a hanger-receiving portion in an upper part, the hanger-receiving portion including a beam-like supporting part;

an outdoor heat exchanger including a first heat exchanger provided inside the body frame and extending along the air inlet, and a second heat exchanger extending along an inner surface of the first heat exchanger;

a hanging portion including a first hanger element engaging with the first heat exchanger, and a second hanger element engaging with the second heat exchanger; and a connecting element connecting the hanger-receiving portion and the hanging portion to each other, wherein the outdoor heat exchanger is supported by the hanger-receiving portion through the hanging portion and the connecting element.

2. The outdoor unit for an air-conditioning apparatus of claim 1, wherein the outdoor heat exchanger further includes a third heat exchanger provided between the first heat exchanger and the second heat exchanger and extending along the inner surface of the first heat exchanger, wherein the hanging portion further includes a third hanger element engaging with the third heat exchanger, and wherein the connecting element connects the hanger-receiving portion, the first hanger element, the second hanger element, and the third hanger element to one another.

3. The outdoor unit for an air-conditioning apparatus of claim 2, wherein the first hanger element and the second hanger element each include a stem portion having a pillar shape; and a locking portion extending in a height direction from the stem portion and having a hook shape, wherein the third hanger element includes a retaining portion having a catch shape, and wherein part of the connecting element is in contact with an upper surface of the supporting part and the connecting element has a first groove in which a distal end of the locking portion of the first hanger element is fitted;

a second groove in which a distal end of the locking portion of the second hanger element is fitted; and an engaging portion engaging with the retaining portion.

4. The outdoor unit for an air-conditioning apparatus of claim 3, wherein the first heat exchanger, the second heat exchanger, and the third heat exchanger each include a plurality of heat exchanger tubes each extending from one end to an other end and arranged side by side in the height direction, and wherein the first hanger element, the second hanger element, and the third hanger element each include a heat-exchanger-tube-engaging portion engaging with two or more of the heat exchanger tubes that are adjacent to one another in the height direction.

5. The outdoor unit for an air-conditioning apparatus of claim 1, wherein the first hanger element and the second hanger element each include a stem portion having a pillar shape; and a locking portion extending in a height direction from the stem portion and having a hook shape, and wherein part of the connecting element is in contact with an upper surface of the supporting part and the connecting element has a first groove in which a distal end of the locking portion of the first hanger element is fitted; and a second groove in which a distal end of the locking portion of the second hanger element is fitted.

6. The outdoor unit for an air-conditioning apparatus of claim 5, wherein the first heat exchanger and the second heat exchanger each include a plurality of heat exchanger tubes each extending from one end to an other end and arranged side by side in the height direction, and wherein the first hanger element and the second hanger element each include a heat-exchanger-tube-engaging portion connected to the stem portion and engaging with two or more of the heat exchanger tubes that are adjacent to one another in the height direction.

7. The outdoor unit for an air-conditioning apparatus of claim 5, wherein the hanger-receiving portion includes a restricting part extending upward from an end of the supporting part and restricting a movement of the connecting element in a direction from the air inlet toward the outdoor heat exchanger and a movement of the connecting element in a direction from the outdoor heat exchanger toward the air inlet.

8. The outdoor unit for an air-conditioning apparatus of claim 1, wherein the connecting element is adhesive.

9. The outdoor unit for an air-conditioning apparatus of claim 1, wherein the connecting element is a screw.

10. The outdoor unit for an air-conditioning apparatus of claim 1, wherein the hanging portion is provided at a central part of the outdoor heat exchanger in a length direction from one end to an other end of the outdoor heat exchanger.

11. The outdoor unit for an air-conditioning apparatus of claim 1, wherein the outdoor heat exchanger has a long-side portion and a short-side portion, and wherein the hanging portion is provided at an upper part of the long-side portion.

12. The outdoor unit for an air-conditioning apparatus of claim 1, wherein a plurality of the hanging portions are provided at an upper part of the outdoor heat exchanger.

* * * * *